US009872576B2

(12) United States Patent
Vitale

(10) Patent No.: US 9,872,576 B2
(45) Date of Patent: Jan. 23, 2018

(54) PILLOW COVER AND PILLOW

(71) Applicant: JLJ Home Furnishing LLC, Lancaster, SC (US)

(72) Inventor: Rory D. Vitale, Charlotte, NC (US)

(73) Assignee: JLJ Home Furnishings LLC, Lancaster, SC (US)

( * ) Notice: Subject to any disclaimer, the term of this patent is extended or adjusted under 35 U.S.C. 154(b) by 89 days.

(21) Appl. No.: 14/849,689

(22) Filed: Sep. 10, 2015

(65) Prior Publication Data

US 2016/0073799 A1 Mar. 17, 2016

Related U.S. Application Data

(60) Provisional application No. 62/050,539, filed on Sep. 15, 2014.

(51) Int. Cl.
*A47G 9/10* (2006.01)
*A47G 9/02* (2006.01)

(52) U.S. Cl.
CPC ..... *A47G 9/0253* (2013.01); *A47G 9/10* (2013.01); *A47G 2009/1018* (2013.01)

(58) Field of Classification Search
CPC ..... A47G 9/0238; A47G 9/0253; A47G 9/10; A47G 9/109
See application file for complete search history.

(56) References Cited

U.S. PATENT DOCUMENTS 3,109,182 A 11/1963 Doak
4,480,346 A * 11/1984 Hawkins ..... A47G 9/0253 5/490
4,480,347 A * 11/1984 Hawkins ..... A47G 9/0253 5/490
5,084,928 A 2/1992 Skillington
6,760,935 B1 7/2004 Burton et al.
6,988,286 B2 * 1/2006 Schecter ..... A47G 9/10 5/645
8,464,376 B1 6/2013 Waite
8,572,779 B2 11/2013 Pratt et al.
8,646,134 B1 * 2/2014 Alletto, Jr. ..... A47G 9/1036 5/490
2004/0068795 A1 * 4/2004 Hollander ..... A47G 9/10 5/502
2008/0010750 A1 * 1/2008 Tidwell ..... A47D 13/08 5/655

* cited by examiner

*Primary Examiner* — Nicholas F Polito
(74) *Attorney, Agent, or Firm* — Hammer & Associates, P.C.

(57) ABSTRACT

A pillow cover includes a top sheet with a peripheral edge, a bottom sheet with a peripheral edge, and a gusset. The gusset is affixed between the top sheet peripheral edge and the bottom sheet peripheral edge. The gusset is stretchable in a circumferential direction. A pillow includes a stuffing material, and the foregoing the foregoing pillow cover for encasing the stuffing material. When the pillow cover is stuffed with the stuffing material, the stretchable gusset crowns the pillow.

4 Claims, 2 Drawing Sheets

PILLOW COVER AND PILLOW

RELATED APPLICATION

This application claims the benefit of U.S. Provisional Application No. 62/050,539 filed Sep. 15, 2014, incorporated herein by reference.

FIELD OF THE INVENTION

The invention is directed to a pillow cover and a pillow including the pillow cover.

BACKGROUND OF THE INVENTION

Conventional pillow covers typically include a top sheet and a bottom sheet that are sewn together around the peripheral edges of the sheets.

As the pillows are used, they then to flatten. These flattened pillows are undesirable. It is often necessary to fluff the pillow, so that it's loft (or crown) is returned.

Accordingly, there is a need for a pillow that retains its loft (or crown).

SUMMARY OF THE INVENTION

A pillow cover includes a top sheet with a peripheral edge, a bottom sheet with a peripheral edge, and a gusset. The gusset is affixed between the top sheet peripheral edge and the bottom sheet peripheral edge. The gusset is stretchable in a circumferential direction. A pillow includes a stuffing material, and the foregoing the foregoing pillow cover for encasing the stuffing material. When the pillow cover is stuffed with the stuffing material, the stretchable gusset crowns the pillow.

DESCRIPTION OF THE DRAWINGS

For the purpose of illustrating the invention, there is shown in the drawings a form that is presently preferred; it being understood, however, that this invention is not limited to the precise arrangements and instrumentalities shown.

DESCRIPTION OF THE INVENTION

Figure 1:
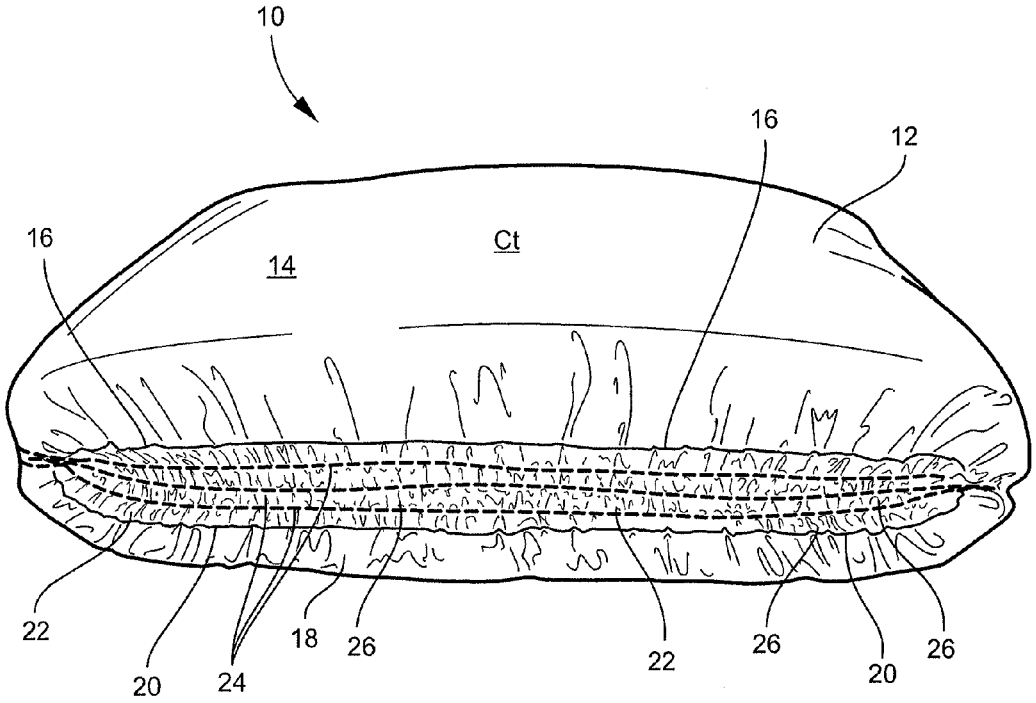
FIG. 1 is environmental view of an embodiment of the instant invention (filled or with stuffing) showing how the elastic gusset crowns the pillow.

Referring to the drawings, where like elements have like numerals, there is shown in FIG. 1 an embodiment of the instant invention. A pillow 10 generally includes a pillow cover 12 encasing a stuffing material (not shown). The pillow has a crowned upper and lower surface, designated $C_t$ (crown top). The pillow may have any shape and/or size. For example, the pillow shape may be a bed pillow, body pillow, decorative pillow, euro pillow, and/or a sham stuffer pillow. The pillow size may be any size. For example, the pillow size may be 18"×24", 18"×26", 18"×34", 20"×26", 20"×28", 20"×30", 20"×36", 12"×12", 12"×14", 14"×14", 16"×16", 18"×18", 20"×20", 22"×22", 24"×24", 26"×26", 20"×48", and/or 20"×54". While the invention is disclosed with reference to a pillow cover, it may also be configured as a pillow case.

The stuffing material may be any stuffing material. Stuffing material may include, but is not limited to fibers (e.g., fiberfill), foam, and/or feathers (e.g., down). The stuffing material may or may not be encased in a separate cover.

Figure 2:
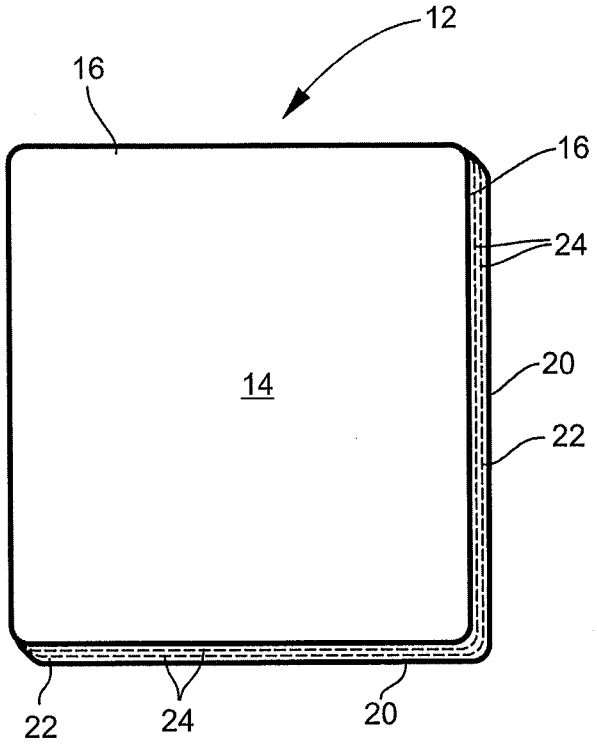
FIG. 2 is a top view of an embodiment of the instant invention (unfilled or without stuffing).
Figure 3:
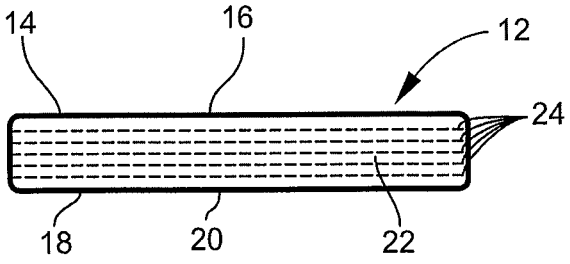
FIG. 3 is a side elevational view of an embodiment of the instant invention (unfilled or without stuffing).

The pillow cover 12, see FIGS. 2 and 3, generally includes a top sheet 14 with a peripheral edge 16, a bottom sheet 18 with a peripheral edge 20, and gusset 22. The gusset encircles the perimeter of the pillow cover 12 (or extends around the circumference of the pillow cover).

The top sheet 14 and the bottom sheet 18 may be made of any material. Such materials include, but are not limited to, woven fabric, nonwoven fabric, knitted fabric, laminates, or leather (natural or synthetic). The top sheet 14 and bottom sheet 18 may have any planar shape. Such shapes include, but are not limited to, circular, triangular, rectangular, or square. Typically, the top sheet and the bottom sheet may have the same dimensions. The top sheet and bottom sheet may have sufficient size to allow the stuffing material to crown the top and bottom sheet, when the stuffing material is inserted into the pillow cover.

Gusset 22 refers to an area between the top sheet 14 and the bottom sheet 18 which is elastic in the circumferential direction around the pillow. Gusset 22 is a elastic band that stretches in its lengthwise direction (or circumferential direction when affixed to the top and bottom sheet). Gusset 22 lateral edges are affixed to the top sheet's peripheral edge and the bottom sheet's peripheral edge. The gusset may be affixed to the top sheet and bottom sheet in any conventional fashion, e.g. sewing. The gusset may be of any construction. In one embodiment, the gusset may be a fabric strip with pleats 26 and have one or more elastic members 24 sewn therein. Elastic members 24 may be any elastic member that stretches in its longitudinal direction. Elastic member 24 may be a thread, cord, strip, or core-wrapped yarn. The number of elastic members will be a function of the elastic strength of the member and the combined elastic strength of the members should be sufficient to crown the pillow. The gusset may be any width. For Example, the gusset may have a width of 1"-10".

The gusset 22 may affixed to the top sheet 14 and the bottom sheet 18 in a relaxed state or a contracted state.

In use, when the stuffing material is inserted into the cover 12, the gusset 22 stretches (or expands in the circumferential direction). After insertion, the gusset 22 wants to return to its original state (relaxed or contracted), and by so doing forces the stuffing material into itself (i.e., toward the center of the pillow) and thereby crowns the pillow (the stuffing material expands at the center of the pillow, $C_t$—FIG. 1).

The present invention may be embodied in other forms without departing from the spirit and the essential attributes thereof, and, accordingly, reference should be made to the appended claims, rather than to the foregoing specification, as indicating the scope of the invention.

I claim:

1. A pillow cover for a pillow comprising:

a top sheet with a peripheral edge;

a bottom sheet with a peripheral edge;

a circumference being located between the top sheet and the bottom sheet; and a pleated fabric strip affixed in a relaxed state between the top sheet peripheral edge and the bottom sheet peripheral edge around the circumference of the pillow cover, the pleated fabric strip being stretchable in a circumferential direction, the pleated fabric strip has two or more circumferential elastic members positioned between the top sheet peripheral edge and the bottom sheet peripheral edge;

wherein when a stuffing material is inserted into the cover, the pleated fabric strip expands in the circumferential direction, and after insertion, the pleated fabric strip relaxes and thereby crowns the stuffing material in the cover.

2. The pillow cover of claim 1 wherein the pleats are generally perpendicular to the stretch direction of the pleated fabric strip.

3. A pillow comprising:

a stuffing material; and a pillow cover for encasing the stuffing material, wherein the pillow cover includes:

a top sheet with a peripheral edge;

a bottom sheet with a peripheral edge;

a circumference being located between the top sheet and the bottom sheet; and a pleated fabric strip affixed in a relaxed state between the top sheet peripheral edge and the bottom sheet peripheral edge around the circumference of the pillow case, the pleated fabric strip being stretchable in a circumferential direction, the pleated fabric strip has two or more circumferential elastic members positioned between the top sheet peripheral edge and the bottom sheet peripheral edge;

wherein when the stuffing a material is inserted into the cover, the pleated fabric strip expands in the circumferential direction, and after insertion, the pleated fabric strip relaxes and thereby crowns the stuffing material in the cover.

4. The pillow of claim 3 wherein the pleats are generally perpendicular to the stretch direction of the pleated fabric strip.

* * * * *